United States Patent [19]

Reed

[11] 4,055,048

[45] Oct. 25, 1977

[54] APPARATUS AND METHOD FOR SIDE STREAM DEMINERALIZATION OF CONDENSATE IN A STEAM CYCLE

[76] Inventor: Charles W. Reed, 5174 Brookside Lane, Concord, Calif. 94521

[21] Appl. No.: 716,319

[22] Filed: Aug. 20, 1976

[51] Int. Cl.[2] ..... F01K 19/00

[52] U.S. Cl. ..... 60/646; 60/657; 60/692

[58] Field of Search ..... 60/657, 646, 670, 690, 60/692

[56] References Cited

U.S. PATENT DOCUMENTS

| | | | |
|---|---|---|---|
| 3,336,747 | 8/1967 | Applebaum | 60/657 |
| 3,572,036 | 3/1971 | Beckman | 60/646 |

*Primary Examiner*—Allan M. Ostrager
*Attorney, Agent, or Firm*—Townsend and Townsend

[57] ABSTRACT

Condensate purification such as demineralization, filtration or sterilization for use in a power plant of the type having at least one main condenser with a hot well as part of the steam cycle and in which the condenser is connected to receive steam from a turbine generator and the hot well is connected to discharge to a main condensate pump. Purification of the condensate is executed with improved method and apparatus comprising a side stream demineralization system. The improvement includes a baffle mounted within said main condenser defining an upstream portion of the condenser on one side of the baffle and a downstream portion of the condenser on the other side of said baffle. The condenser hot well is located on the downstream side of the baffle. A passageway is defined over the baffle for flowing fluid therethrough to the hot well. The passageway includes a weir cooperatively disposed therewith on the upstream side of the baffle to hold back a pool of fluid from flowing through the passageway. Apparatus for water purification comprising demineralizers is spaced apart from the condenser. A first pipe connects said pool of fluid with the purification apparatus. A pump is connected with the first pipe for causing fluid flow through the purification apparatus. A second pipe is provided for connecting the water purification apparatus with said pool for recirculating water back to the pool for further purification. A third pipe connects said purification apparatus with the downstream side of the baffle so that the condensate water can reach said hot well. Optionally the condensate can be reheated while flowing towards the hot well.

10 Claims, 2 Drawing Figures

APPARATUS AND METHOD FOR SIDE STREAM DEMINERALIZATION OF CONDENSATE IN A STEAM CYCLE

BACKGROUND OF THE INVENTION

This invention relates to condensate used in a steam cycle. More particularly, it relates to a method and apparatus for purification of the condensate. The term purification is used to cover removal, reduction or neutralization of any undesired content in the condensate such as by demineralization, filtration or sterilization to kill germs, either singly or in combination.

Many conventional full flow condensate demineralizers in nuclear and other power plant cycles are located in a series flow arrangement in the feed water system downstream of the main condensate pump. This demineralizer equipment is, therefore, designed for the maximum system pressure, which is usually about 600–700 psi design, with normal operating pressures of about 500 psi. If the demineralizers in such a system are bypassed for operating purposes, the resulting reduction in the pressure against the condensate pump could upset the pumping system and thus decrease the power efficiency of the power plant even though throttling controls are used in the bypass operation. Demineralizers in such a series flow arrangement do not have recirculation capability and also do not provide the capacity required to handle demineralizer clean-up necessitated by either excessive condenser leakage or excessive mineral content in the water, thus requiring a plant shut-down in these instances.

SUMMARY OF THE INVENTION

The side stream condensate demineralizer system of this invention can operate with high mineral content condensate and provides additional benefits. This invention permits bypassing of the demineralizers when desired for operating purposes without upsetting the pumping system. The present design also provides the capability for handling excessive condenser leakage and condensate mineral content in a condenser that is part of a system utilizing several condensers, all of which are connected to the demineralizers. In this case the single leaking condenser alone can be serviced by all of the demineralizers.

These benefits are achieved by placing the demineralizers in the condenser circuit upstream of the main condensate pump. If no demineralization is required, the demineralizers may be bypassed without affecting the pump system as the upstream bypass to the demineralizers does not effect the discharge pressure from the condensate pump.

In normal operation, the present invention will usually be used to intercept full condensate flow and discharge to the main condenser hot well ready for use in the steam cycle. However, if the mineral content is still too high after passing through the demineralizers, the water can be recirculated through the main condenser until tolerable limits are achieved before the condensate is directed to the main condenser hot well and then to the condensate pump thereby avoiding plant shutdown.

Additional features of the side stream system are that it can operate at low pressures, such as at about 50–100 psi, utilizing the side stream condensate pump, and at relatively lower temperatures, about $<134°$ F, because the water being treated is upstream of the hot well and has not yet been preheated in the condenser hot well where provision is made for such reheating. These features offer substantial cost reductions in the demineralization system and the resins required for it. Where a reheat zone is utilized in the condenser, the present invention provides condensate of lower temperature for contact with the demineralization resins thereby extending resin life.

DESCRIPTION OF THE PRIOR ART

The closest prior art relative to the present method and system is a bypass water treating system designed for Cleveland Electric Illuminating Company for its Avon station, as reported in Electrical World, July 2, 1959, particularly at pages 18, 26 and 31. This Avon installation is essentially designed for tube-to-tube sheet joint weepage. The Avon system contains several major potential operating problems in common with conventional full flow series demineralizers. In the Avon design, tube rupture is detected at the hot well pump. This is too late to prevent downstream contamination. In the present invention, contamination can be detected by sampling upstream of a horizontal baffle in the main condenser before the condensate is released to the hot wells. Further, in the Avon system, in the event of a tube rupture and a switch to the bypass system, the demineralizer pumps can no longer be bypassed but must be used in series with the condensate pump. This then results in a series system with the demineralizer pump pumping through the suction of the hot well pumps and for practical purposes has the same drawbacks as the conventional series flow demineralization arrangement. As will be better understood from a consideration of the accompanying drawings, the present design is free from these problems.

DESCRIPTION OF THE PREFERRED EMBODIMENTS

Figure 1:
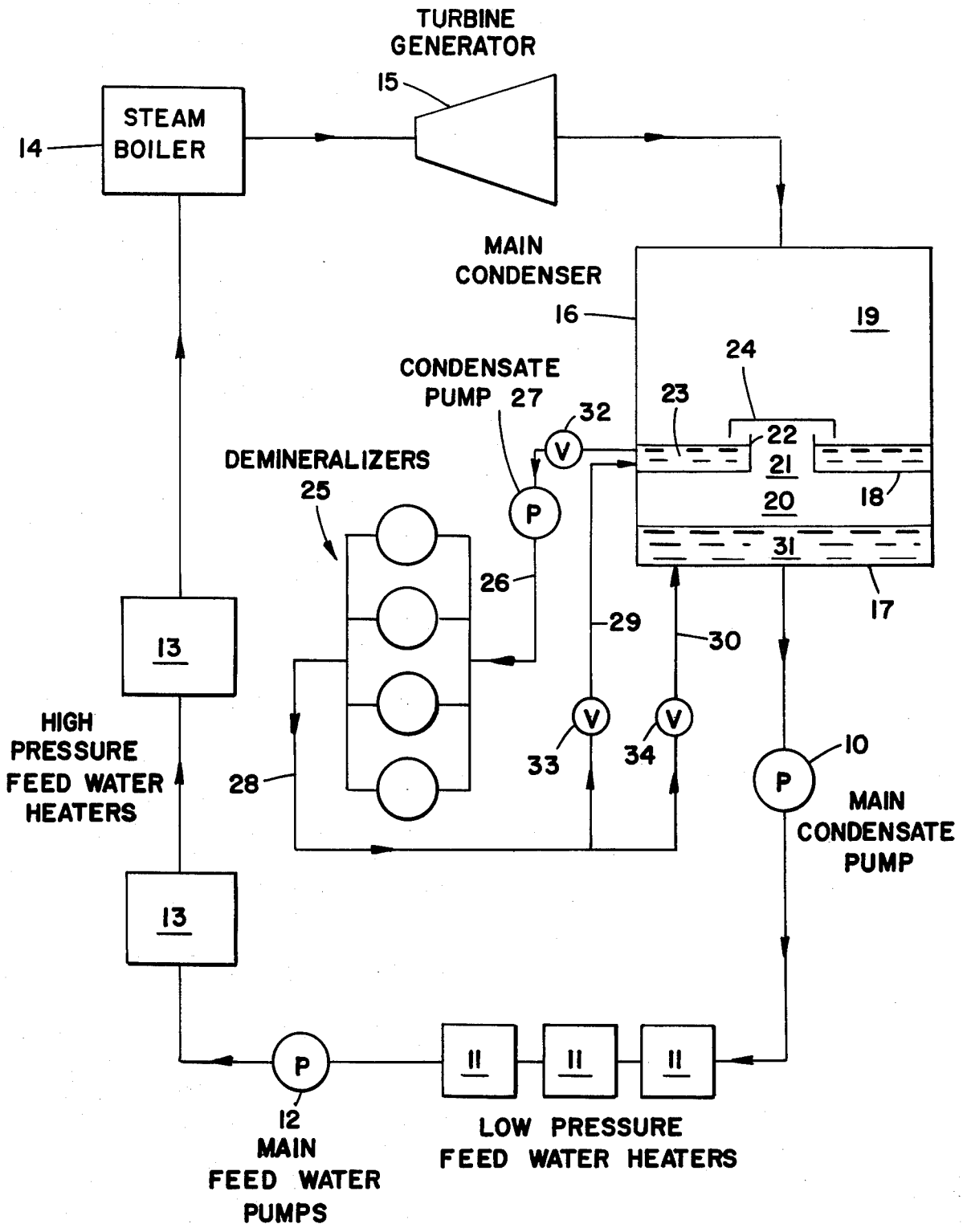
FIG. 1 is a schematic steam cycle having a single condenser using the present side stream system.

In the accompanying drawings, FIG. 1 shows a steam cycle for a power plant in which the working fluid path includes a main condensate pump 10 in fluid communication with a series of low pressure feed water heaters 11 which flow to the main feed water pump 12. Main feed water pump 12 communicates with high pressure feed water heaters 13 from which the feed water is returned to steam boiler 14. Steam from boiler 14 operates turbine generator 15 from which the steam is flowed to main condenser 16. Main condenser 16 typically includes a hot well portion 17 at the downstream end of condenser 16. It will be understood that the above cycle is for illustration only and the present improvement is equally applicable to the many possible variations and additions to a steam cycle.

The present side stream purification system includes a divider or horizontal baffle 18 defining an upstream portion 19 of condenser 16 and a downstream portion 20. Passageway 21 through divider 18 opens fluid communication between upstream portion 19 and downstream portion 20 of condenser 16. Horizontal baffle 18 includes weir 22 adjacent to passageway 21 to hold back a pool of condensate fluid 23 on the upstream side of baffle 18. There is further included a splash baffle 24 disposed over passageway 21 and weir 22 to prevent condensate from moving directly through passageway 21 and thereby avoiding residence in pool 23.

A bank of water purification apparatus, usually a bank of condensate demineralizers 25, is spaced from condenser 16. Pipe 26 is connected between pool 23 and demineralizers 25 and includes condensate pump 27 for causing fluid flow through pipe 26 and demineralizers 25. Pipe 28 receives demineralized condensate from demineralizers 25 and recirculates the same to pool 23 through pipe 29. Alternatively the demineralized condensate may be flowed through pipe 30 for communication with the downstream side of divider 18 and in communication with condensate 31 in hot well 17. Valves 32, 33 and 34 are adapted to selectively open and close fluid flow through pipes 26, 29 and 30, respectively.

When the power plant is operating but no demineralization of the condensate is required, valve 32 may be closed and pump 27 inactivated whereby condensate in pool 23 will thus overflow weir 22 and pass directly to the condensate water 31 in hot well 17 completely bypassing the demineralization system. When demineralization is desired, valve 32 is opened and pump 27 is activated. In a normal full flow demineralization in which no recirculation is required, valve 33 is closed and valve 34 is opened whereby demineralized condensate is passed to the condensate in hot well 17.

In a start-up, emergency contamination situation, or when further demineralization is required, valve 34 can be closed and valve 33 opened. Thus condensate from pool 23 flowing through pipe 26 and demineralizers 25 is recirculated through pipe 29 back to pool 23. Such recirculation may be continued until the contamination level in the fluid is at an acceptable level. In some designs of main condensers used in a steam cycle, there is provision for reheating the condensate either while it is in the hot well or, more usually, on its passage to the hot well. In such a unit the demineralized condensate returning to the main condenser in pipe 30 will be introduced into the main condenser at an appropriate location so that the condensate can pass through the reheating zone in the main condenser. For example, in the embodiment of FIG. 1 pipe 30 would be located so that the condensate would enter the main condenser at a location above condensate water 31 so that the return flow would pass through the reheating zone before reaching condensate water 30.

In a typical installation, there may be three main condensers in the steam cycle receiving steam from three low pressure turbine elements of the main turbine. Where there is excessive leakage in one of the condensers, the side stream system of this invention permits the diversion of all of the water from the leaking condenser through the demineralization system while permitting the two properly operating condensers to pass their condensate directly through the passageway in their baffles to their hot wells. Similar flexibility is available during start-up situations. Additional flexibility is available by adjusting valves 33 and 34 to recirculate a portion of the demineralized condensate while flowing a portion to hot well 17.

Figure 2:
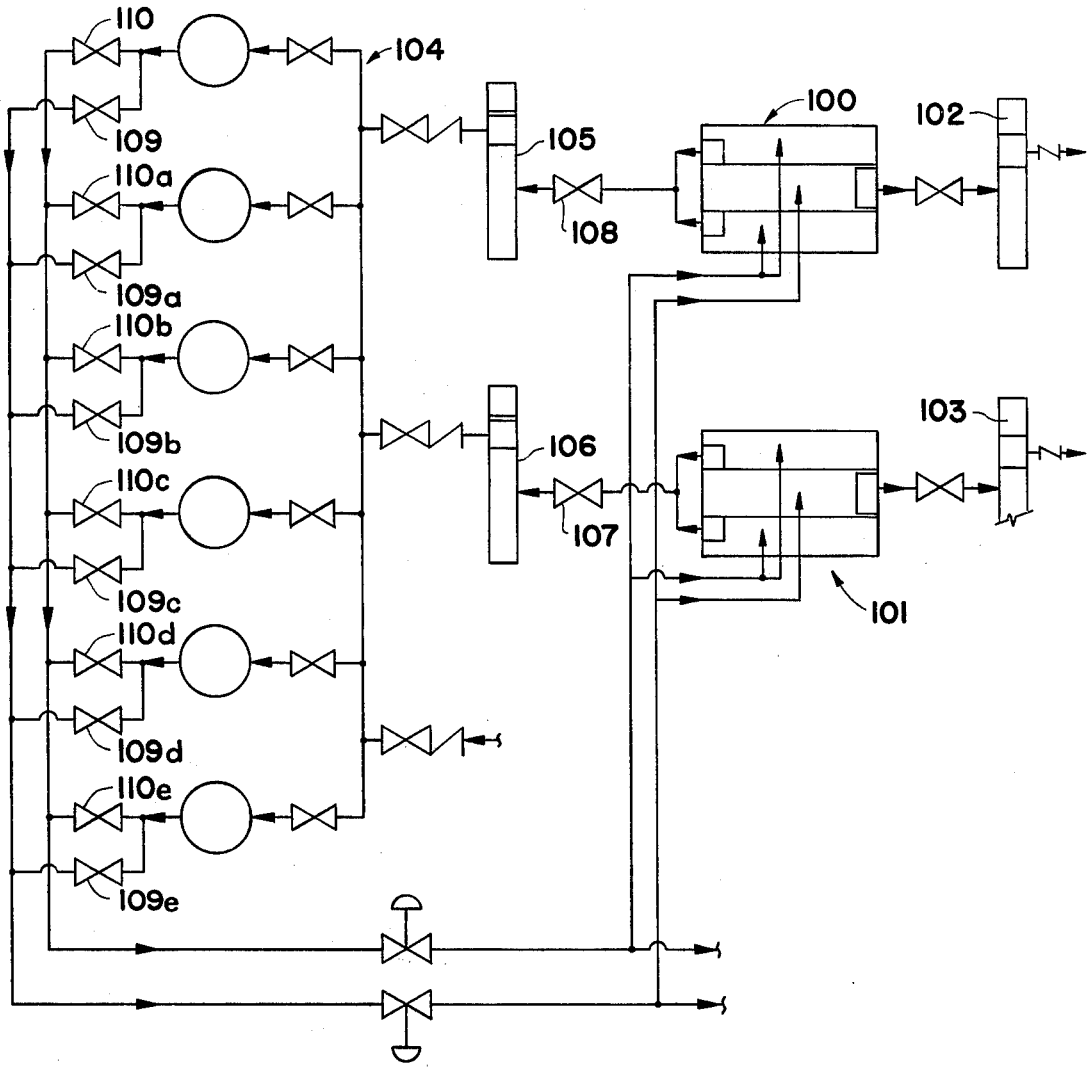
FIG. 2 is a schematic of a part of a steam cycle having plural condensers connected for using the present side stream system.

The embodiment in accompanying FIG. 2 illustrates the manner of interconnecting the plurality of main condensers with a single demineralization system. Thus, main condensers 100 and 101 are connected with condensate pumps 102 and 103, respectively, which form part of a steam cycle as illustrated in FIG. 1. Usually three main condensers will be employed in such a system, although the same principle would apply to any number of main condensers desired. The condensate pump from each main condenser, such as pump 102, would normally discharge to low pressure feed water heaters (not shown) and the output from all such heaters consolidated for flow through the remainder of the system as shown in FIG. 1.

With respect to the purification of the condensate in the main condensers, a bank of demineralizers is shown at 104. Condenser 100 is connected to demineralizers 104 and condensate is pumped through polisher or condensate pump 105. The condensate in main condenser 101 is similarly connected and is pumped to demineralizers 104 through condensate pump 106. In an excessive leakage situation as mentioned above, valves such as valve 107 are closed on all properly functioning main condensers. Assuming a contamination problem in main condenser 100, valve 108 is opened and the condensate in main condenser 100 is pumped through the entire demineralization bank 104. The condensate may be recirculated until contamination is reduced to an acceptable level by closing valves **109–109*e* and opening valves 110–110*e*. Conversely, the condensate can be passed to the hot well of main condenser 100 when recirculation is to be terminated or if only a single pass through the demineralization bank 104** is desired.

Special features of the system to be noted include the ability of detecting contamination at an early stage before the contamination proceeds downstream. Contamination may be detected while the condensate is in pool 23 on the upstream side of baffle 18. If detected, the condensate may be recirculated through pipe 26, demineralizers 25, and pipes 28 and 29 until the contamination is sufficiently reduced. It should be further noted that at no time is demineralizer condensate pump 27 used in series with main condensate pump 10. Consequently, condensate pump 27 can be designed for 100 psi or lower operation.

While I have illustrated and described two preferred embodiments of my invention, it is to be understood that such are merely illustrative and not restrictive and that variations and modifications may be made herein without departing from the spirit and scope of the invention. I therefore do not wish to be limited to the precise details set forth but desire to avail myself of such changes as fall within the purview of my invention.

What is claimed is:

1. In a power plant steam cycle having at least one main steam condenser with a hot well, a side stream condensate purification system for clean-up of the feed water comprising: divider means in said condenser disposed for separating condensate on a first side of said divider means from condensate on the second side of said divider means and in the hot well; a passageway through said divider means for flowing condensate from the first side thereof to the second side thereof and to said hot well; means for removing impurities from said feed water spaced from said condenser; first conduit means defining a fluid path from the first side of said divider means to said means for removing impurities; second conduit means defining a fluid path from said means for removing impurities to the first side of said divider means; and third conduit means defining a fluid path from said means for removing impurities to the second side of said divider means.

2. A side stream condensate purification system in accordance with claim 1, and including valve means in combination with each of said first, second and third conduit means for selectively opening and closing fluid flow through each of said conduit means.

3. A side stream condensate purification system in accordance with claim 1, and including means in combination with said passageway to retain a preselected volume of water on the first side of said divider means.

4. Improved apparatus for purification of the condensate used in a power plant, said power plant of the type having a main condenser with a hot well as part of a steam cycle and in which said condenser is connected to receive steam from a turbine generator and said hot well is connected to discharge to a main condensate pump, said improved apparatus comprising: a baffle mounted within said condenser defining an upstream portion of the condenser on one side of the baffle and a downstream portion of the condenser on the other, said hot well being on the downstream side of said baffle; a passageway defined through said baffle for flowing fluid towards said hot well; said passsageway having a weir cooperatively disposed therewith on the upstream side of said baffle to hold back a pool of fluid from flowing through said passageway; apparatus for water purification including demineralization spaced from said condenser; a first pipe for connecting said pool of fluid with said purification apparatus; a pump connected with said first pipe for causing fluid flow through said purification apparatus; a second pipe for connecting said water purification apparatus with said pool for recirculating water back to said pool after purification; and a third pipe connecting said purification apparatus with the downstream side of said baffle and in communication with the condensate water within said hot well.

5. Improved apparatus for purification of the condensate used in a power plant in accordance with claim 4, and including valves in association with each of said first, second and third pipes to open and close fluid flow therethrough.

6. Improved apparatus for purification of the condensate used in a power plant in accordance with claim 5, and including a plurality of said main condensers connected to said apparatus for water purification, whereby said valves in association of each of said first, second and third pipes can be positioned to connect selected ones of said main condensers at any given time for fluid flow through said apparatus for water purification.

7. A method for removing impurities from water in a steam generated power plant having a working fluid path including a condenser with a hot well and in which the fluid passes through the condenser to the hot well, said method including the steps of interrupting at least a part of the fluid flow through said condenser upstream of the hot well, withdrawing interrupted fluid from said condenser, separating impurities from said removed fluid at a location spaced apart from said condenser, and then returning said fluid to at least one of (a) the hot well of said condenser, (b) the upstream part of said condenser from which it was withdrawn thereby recirculating the fluid.

8. A method for removing impurities from water in a steam generated power plant in accordance with claim 7, wherein substantially all of the fluid flow through said condenser is interrupted upstream of the hot well, and after impurities are removed all of said fluid is returned to said hot well.

9. A method for removing impurities from water in a steam generated power plant in accordance with claim 7, wherein substantially all of the fluid flow through the condenser is interrupted upstream of the hot well, and after impurities are removed a portion thereof is returned to said upstream part of said condenser and a portion thereof is returned to said hot well.

10. A method for removing impurities from water in a steam generated power plant in accordance with claim 7, wherein substantially all of said fluid is returned to the upstream part of said condenser for recirculation.

* * * * *